United States Patent [19]

Brzezinski et al.

[11] Patent Number: 4,541,328

[45] Date of Patent: Sep. 17, 1985

[54] DAMPER SEAL APPARATUS

[75] Inventors: Donald E. Brzezinski, Waukesha, Wis.; Christy C. Kadue, Minneapolis, Minn.

[73] Assignee: Johnson Service Company, Milwaukee, Wis.

[21] Appl. No.: 577,057

[22] Filed: Feb. 6, 1984

[51] Int. Cl.[4] ..... E06B 7/086

[52] U.S. Cl. ..... 98/121.2; 49/91; 137/601

[58] Field of Search ..... 49/91; 98/110, 121 A; 137/601

[56] References Cited

U.S. PATENT DOCUMENTS

| | | | |
|---|---|---|---|
| 3,084,715 | 4/1963 | Scharres | 137/601 |
| 3,606,245 | 9/1971 | Reichow et al. | 137/601 X |
| 3,885,347 | 5/1975 | Adachi et al. | 98/110 X |
| 4,192,098 | 3/1980 | Brzezinski | 137/601 X |
| 4,256,143 | 3/1981 | Magill et al. | 137/601 |

*Primary Examiner*—Harold Joyce

*Attorney, Agent, or Firm*—Larry L. Shupe; Joseph J. Jochman, Jr.; John P. Ryan

[57] ABSTRACT

In general, a sealing apparatus for substantially preventing the flow of air through a damper assembly having a plurality of movable vanes includes a first, rigid sealing member having a generally circular cross-section and adapted to be attached to a first edge of a first movable vane. The first edge is movable through a first arc between a damper-open position and a damper-closed position. A second resilient sealing member has a generally rectangular cross-section and is adapted to be attached to a second edge of a second movable vane. The second edge is movable through a second arc between the damper-open and damper-closed positions. The sealing members make substantially line contact one with the other as the edges are moved toward the damper-closed position and are in substantially gas flow-preventing area contact one with the other when the vanes are in the damper-closed position.

5 Claims, 5 Drawing Figures

DAMPER SEAL APPARATUS

This invention relates generally to fluid flow sealing devices and more particularly to sealing apparatus useful in dampers for controlling the flow of a gaseous fluid through a duct.

Positionable dampers are widely used in building heating, ventilating and air conditioning systems for controlling the flow of air within building ductwork or between the building and the outdoor ambient. Depending upon the nature of the system, these dampers may range in size from a few square feet to well over one hundred square feet in frontal area and typically include a plurality of generally planar blades or vanes, each being pivotably supported along an axis which is parallel to and spaced equidistant between the blade edges. The drive linkage which couples the vanes to the motive device, typically a linear actuator or rotary motor, may be constructed and arranged so that, when the vane ends are viewed, all vanes conformably rotate on their respective support axes in the same direction whenever the damper is positioned. In the alternative, the drive linkage may be arranged so that each vane is rotated in a direction counter to that of vanes adjacent either edge thereof and the damper seal apparatus which is the subject of this application is most useful in dampers having vanes of the latter, counter-rotating type.

Fundamental to damper function is that it exhibit the ability to substantially fully seal the duct when in a closed position, permitting only a minimal amount of leakage air to pass therethrough. This function is preferably performed by providing a seal apparatus in which those parts of the vane edge seals which abut edge seals of adjacent vanes or of the damper frame define a sealing area rather than a line of sealing contact, the latter as might result from the abutment of two arcuate, relatively rigid edges. Additionally, and in view of the fact that the vanes perform the sealing function by being rotated to an edge abutting relationship with the stationary damper frame and/or with adjacent vanes, it is preferred that the seal apparatus be of a type which permits the application of a relatively low torque to the drive linkage as this has advantageous implications for the sizing and therefore the cost of the motive device.

One approach to the design of a damper seal apparatus is shown and described in U.S. Pat. No. 3,084,715 and includes vanes, each being formed almost entirely of resilient material but for a central stiffening member. Each vane edge defines an arcuate profile which is identical to that of the edge of the adjacent vane with which it seals. The use of two arcuate surfaces and a relatively thick web section at the sealing edges suggests that only a small area of sealing and a higher closure torque will result from the use of seals of this type. Additionally, sealing between a vane and the damper frame is by sliding the arcuate vane sealing edge across a resilient web, a construction likely to result in undue wear and to require a motive device of unnecessarily increased size.

Another type of damper seal is illustrated in U.S. Pat. No. 3,885,347 and incorporates an edge seal of generally circular cross-section which abuts rigid, planar surfaces on the opposing edge of the adjacent vane and on the damper frame for sealing. Little or no deformation of the circular seal is indicated and only a line of sealing contact is suggested. Further, the sliding of the circular seal across the planar surface of the damper frame suggests a requirement for unnecessary wear and an undesirable increase in size of the motive device.

Other types of damper seal apparatus include resilient, conformably profiled vane sealing lips which are brought to an abutting, overlapped relationship when the damper is closed. While designs of this type provide a relatively large area of sealing, they are unsuited for use in dampers having the aforedescribed arrangement in which a vane rotates contra to those immediately adjacent thereto whenever the damper is being adjusted to a position. Also, greater care must be taken during damper assembly in order to assure that the sealing lips are correctly mounted on the vane. An example of an apparatus of this type is shown in U.S. Pat. No. 3,275,031.

While these sealing apparatus have heretofore been satisfactory, they have failed to appreciate the manner in which damper seals may be constructed and arranged to provide a relatively large area of sealing when the damper is closed while yet avoiding an accompanying increase in the size of the damper motive device. Additionally, they have failed to appreciate a manner of sealing between a vane and the adjacent damper frame so as to provide a relatively large area of sealing without the necessity of employing sliding surfaces and the attendant increase in motive device size.

SUMMARY OF THE INVENTION

In general, a sealing apparatus for substantially preventing the flow of air through a damper assembly having a plurality of movable vanes includes a first, rigid sealing member having a generally circular cross-section and adapted to be attached to a first edge of a first movable vane. The first edge is movable through a first arc between a damper-open position and a damper-closed position. A second, resilient sealing member has a generally rectangular cross-section and is adapted to be attached to a second edge of a second movable vane. The second edge is movable through a second arc between the damper-open and damper-closed positions. The sealing members make substantially line contact one with the other as the edges are moved toward the damper-closed position and are in substantially gas flow-preventing area contact one with the other when the vanes are in the damper-closed position.

It is an object of the present invention to provide damper seal apparatus having improved effectiveness for preventing air flow through a duct.

Another object of the present invention is to provide damper seal apparatus which permits reductions in the size of the damper motive device.

Yet another object of the present invention is to provide damper seal apparatus which employs a rigid, generally cylindrical first sealing member and a second sealing member having a generally rectangular cross-section. How these and other objects of the invention are accomplished will become more apparent from the detailed description thereof taken in conjunction with the accompanying drawing.

DESCRIPTION OF A PREFERRED EMBODIMENT

Figure 1:
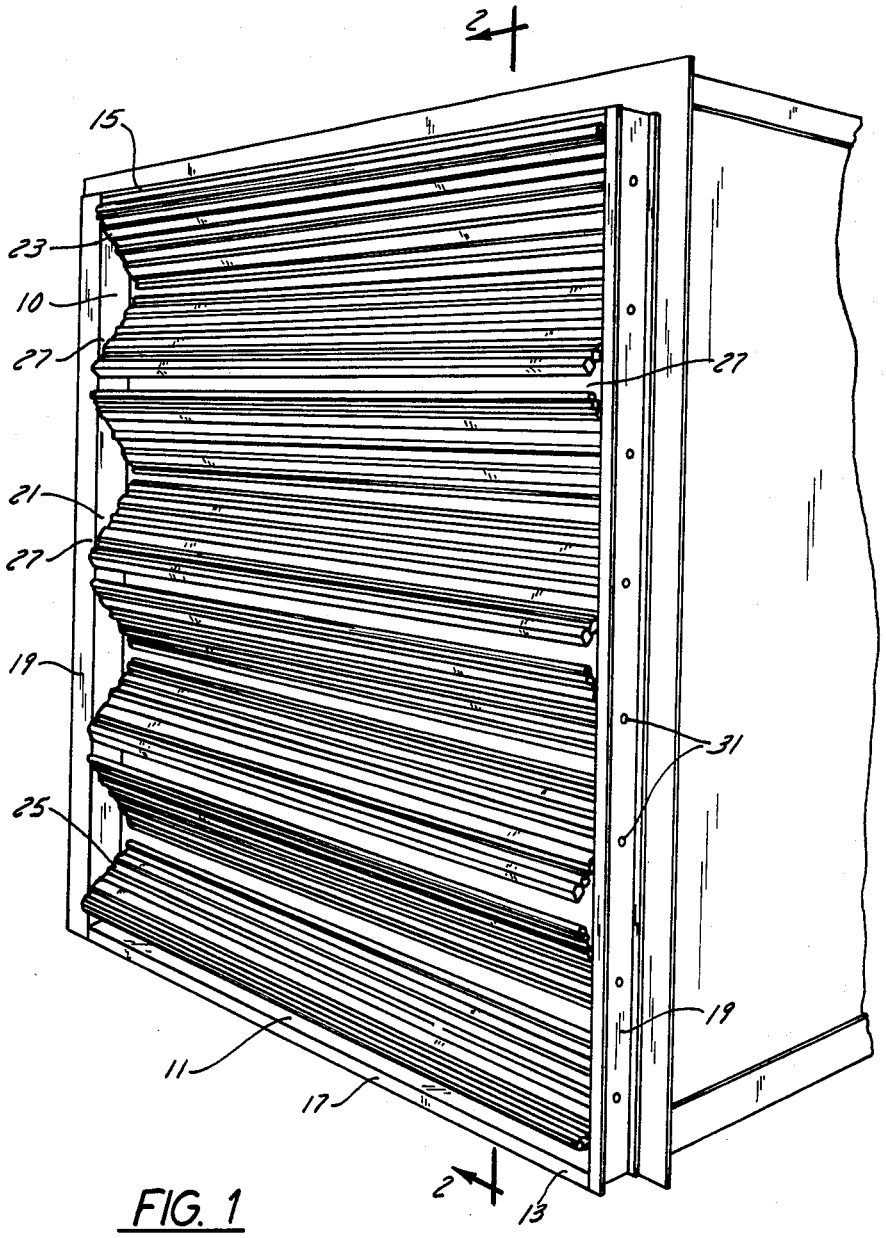
FIG. 1 is an isometric view of an air damper with which the damper seal apparatus of the present invention may be used.
Figure 2:
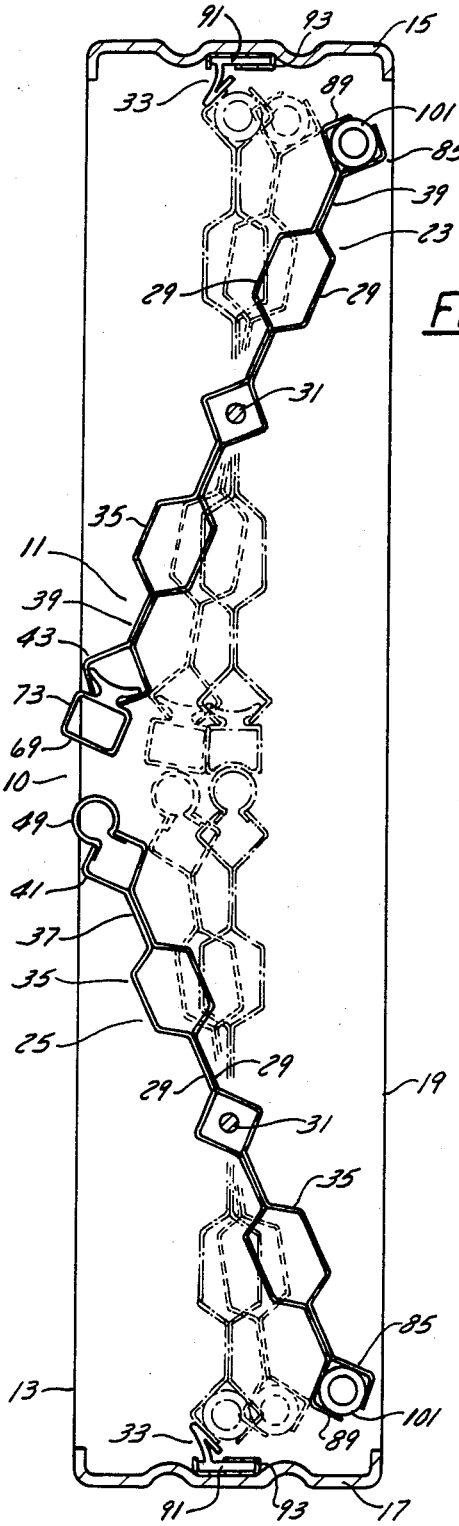
FIG. 2 is a cross-sectional end elevation view of the damper shown in FIG. 1, taken along the plane 2—2 thereof, with the damper vanes shown in an intermediate, partially open position by solid line, in a partially closed, initial sealing position by short dashed line, in a fully closed position by long and short dashed lines and with other portions shown in partial representation.

In FIG. 1, the damper seal apparatus 10 of the present invention is shown in connection with a damper assembly 11 having a generally rectangular frame 13, the outer periphery of which is sized for closely fitted, air flow sealing engagement with an air duct into which it may be installed. The frame 13 includes top and bottom sections, 15 and 17 respectively, and a pair of side sections 19 for pivotably supporting a group of air flow controlling vanes 21. The vane group 21 includes a top perimeter vane 23, a bottom perimeter vane 25 and, typically, a plurality of interior vanes 27. FIG. 2 is configured for ease of understanding to include only top and bottom perimeter vanes 23, 25, respectively and it is to be appreciated that a typical damper would include a plurality of interior vanes 27 disposed therebetween. As shown therein, each vane 23, 25 is formed of two rigid sheets 29 which preferably have identical cross-section profiles and which are arranged in a face-opposing relationship one to the other for attachment to its support rod 31 and for defining vane edges appropriate for attachment of the sealing apparatus 10 or for engaging a third frame sealing member 33, as the case may be. The sheets 29 may have corrugations 35 for stiffening. A motive device and drive linkage (not shown) are coupled to each vane 23, 25 in a known manner and in a fashion such that each vane 23, 25 rotates in a direction counter to any adjacent vane.

Figure 3:
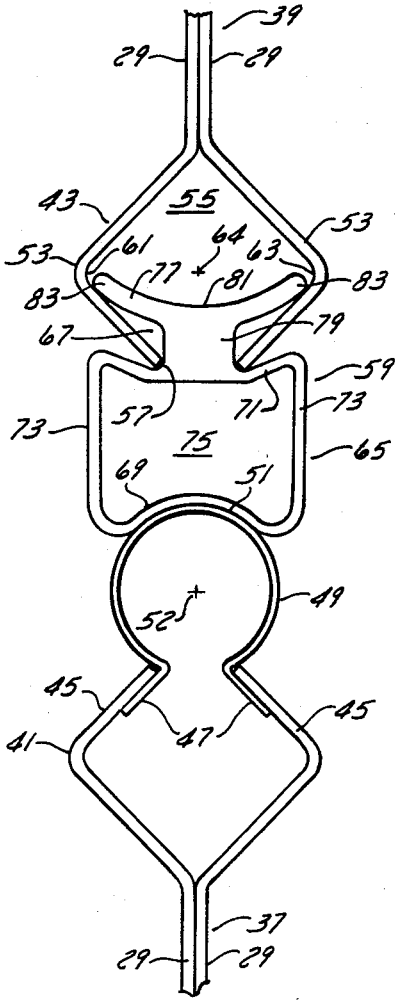
FIG. 3 is an enlarged view of the first and second sealing member portions of FIG. 2, with damper in a fully closed position.

Referring to FIGS. 1, 2 and 3 there is shown a first vane 37 and a second vane 39, each having the ends of its respective support rod 31 mounted for pivoting movement within a side section 19. The first vane 37 includes a first edge 41 movable through a first arc between a damper-open position as shown in FIG. 2 in solid line and a damper-closed position as shown in long and short dashed line. Similarly, the second vane 39 has a second edge 43 movable through a second arc between a damper-open position and a damper-closed position.

Each vane 37, 39 is preferably constructed of a pair of rigid sheets 29 formed to a contour for vane rigidity and attached to one another in face-opposing relationship. The sheets 29 of the first vane 37 each have an angularly formed lip 45 for attaching the support skirt 47 of a tubular, elongate first, rigid sealing member 49. The sealing member 49 has a generally circular periphery, an arc of which constitutes a sealing surface 51. Attachment of the skirt 47 to the lip 45 may be by glueing or spot welding, for example, and for best air flow sealing, it is preferred that the longitudinal tubular axis 52 of the member 49 be parallel to the pivot axis of the support rod 31.

The sheets 29 of the second vane 39 each have an edge 53 formed to a generally V-shaped configuration to define a diamond shaped conduit 55 having a mouth 57 for receiving a second resilient sealing member 59. The conduit 55 has a first apex 61 and a second apex 63, the apexes 61, 63 defining a first dimension therebetween. For best air flow sealing, it is likewise preferred that the longitudinal axis 64 of the conduit 55 be parallel to the pivot axis of its related vane support rod 31.

The second resilient sealing member 59 includes a first sealing portion 65 and a second support portion 67. The first portion 65 has a first top wall 69, a second bottom wall 71 and a pair of side walls 73, the walls 69, 71, 73 thereby generally defining a rectangle. While the first sealing portion 65 may be configured to have a filled, resilient core, a preferred sealing portion 65 will include a hollow core area 75 and relatively thin walls 69, 71, 73 for permitting the top wall 69 to be readily deformed by and conform to the periphery profile of the first sealing member 49 as the first edge 41 and second edge 43 move toward a damper-closed position. The use of thin wall sections also permits the bottom wall 71 to readily deform as the vanes 37, 39 move to the damper-closed position as shown in FIG. 3. Such deforming characteristic has favorable implications both for the air flow inhibiting quality of the seal thereby established and for the required torque of damper closure.

A second, support portion 67 is coupled to the first portion 65 for attachment of the second sealing member 59 to the second edge 43. The support portion 67 preferably includes a foot member 77 attached to the bottom wall 71 of the second sealing member 59 by a resilient support rib 79 and it is to be appreciated that when the second sealing member 59 is detached from the second edge 43 so as to be in a state of free repose, the foot member 77 will be laterally extended, will have a generally planar under surface 81 and will define a second dimension between its ends 83 which is somewhat greater than the first dimension between the apexes 61, 63 of the second edge 43. When fashioned in that manner and when received in the conduit 55, the foot member ends 83 will engage the apexes 61, 63 and their adjacent conduit surfaces for providing two areas of sealing engagement between the second sealing member 59 and the second edge 43. Undesirable air leakage between the member 59 and the edge 43 is thereby substantially prevented. Santoprene, a trademarked product of Monsanto Chemical Co., has been found to be a preferred material for construction of the second sealing member 59.

While the apparatus 10 for sealing between movable vane edges 41, 43 has been shown and described, it is also preferred that means be provided for effecting a substantially airtight seal between a vane edge 85 and its adjacent stationary top or bottom section 15 or 17 respectively. Since the manner of sealing between a top or bottom section 15, 17 and its associated vane 39, 37 respectively are closely similar one to the other, only the manner of sealing at the top section 15 will be described. Accordingly and referring to FIGS. 2, 4 and 5, there is shown a top section 15 to which is attached a third sealing member 39 for substantially preventing the flow of air between the section 15 and its immediately-adjacent perimeter vane 23. In a preferred embodiment, the third sealing member 33 includes a generally planar sealing lip 87 for engaging the generally planar edge face 89 of the adjacent vane 23 as the latter approaches and travels to the damper-closed position. A base 91 is received in a generally G-shaped channel 93 affixed to the section 15 for attachment of the third member 33 thereto while a support rib 95 is disposed between the base 91 and the sealing lip 87 for maintaining the latter in a position to engage the edge face 89 as the vane 23 closes. It is preferable that the plane defined by the sealing surface of the lip 87 be parallel to the plane defined by the edge face 89 as the lip 87 and the face 89 come into sealing contact one with the other. In this manner, a relatively large area of sealing will be immediately established as the vane 23 approaches the position of full closure and the resiliency of the rib 95 and lip 87 permit this area of sealing to be maintained at substantially all times in which the rib 95 and lip 87 are in surface contact one with the other. Decreased vane closure torque will result if the point of attachment 97 of the support rib 95 to the base 91 is displaced laterally from the vertical centerline 99 of the frame top section 15. Displacement is preferably in the direction of travel of the perimeter vane edge 85 when the vane is rotated toward the closed position. Inclusion of a resilient sealing tube 101 within the edges 85 will help avoid whistling sounds otherwise resulting from the high velocity movement of air past the edges 85. For clarity, the tube 101 has been omitted from the depiction of FIG. 4.

Figure 4:
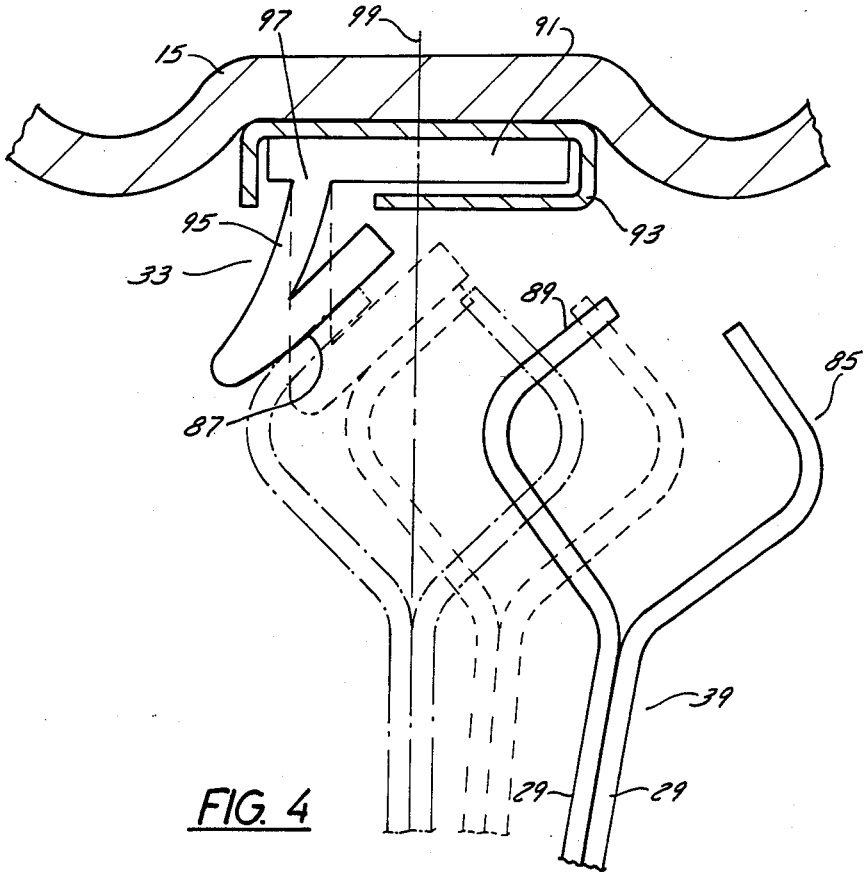
FIG. 4 is an enlarged view of a portion of FIG. 2 and showing the third sealing member.
Figure 5:
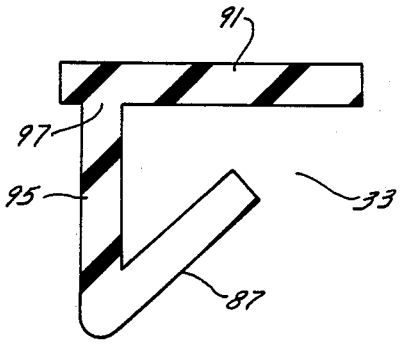
FIG. 5 is an end cross-sectional view of the third sealing member of FIG. 4 and in a position of undeformed repose.

In operation and assuming the vanes 23, 25 are initially in a position shown by the solid line outline of FIG. 2; that is, intermediate the damper-open and damper-closed positions, damper closing force is applied by the motive device and the vanes 23, 25 simultaneously commence rotation toward the position of full damper closure as shown by long and short dashed outlines in FIGS. 2 and 4. As the vanes 23, 25 reach an angular position within about 4 degrees of full damper closure as shown by the short dashed outlines of FIGS. 2, 4, the first sealing member 49 establishes an initial line of contact with the first wall 69. Substantially simultaneously, the edge faces 89 of the perimeter vanes 23, 25 each establish an area of sealing contact with their respective sealing lips 87. As vane rotation continues through an arc of about 4 degrees to the position of full damper closure, the first sealing member 49 progressively deforms the first top wall 69 to establish an area of sealing contact therebetween. During this period of final vane rotation, the lips 87 and ribs 95 deform to maintain the areas of sealing between the edge faces 89 and the lips 87.

Tests have demonstrated that when the damper is fully closed, air leakage therethrough has been reduced about 40% as compared to conventional seal configurations. Further, the torque of closure was reduced by about 50% below that required by conventional seal designs. Additionally, the inventive seal apparatus 10 maintains its effectiveness even though the first sealing member 49, the conduit 55 and/or a perimeter vane edge 85 may be accidentally bent or otherwise deformed so as to have segments which are out of parallel with the longitudinal areas of the support rods 31.

While only a single preferred embodiment of the invention has been shown and described, it is not intended to be limited thereby but only by the scope of the claims which follow.

We claim:

1. Sealing apparatus for substantially preventing the flow of gaseous fluid through a damper assembly having a plurality of movable vanes and including:

a first rigid sealing member having a generally circular cross-section and adapted to be attached to a first edge of a first movable vane, said first edge being movable through a first arc between a damper-open position and a damper-closed position;

a second, resilient sealing member having a top wall for contacting said first member, a pair of generally planar side walls and a bottom wall, said walls defining a generally rectangular cross-section, said second member being adapted to be attached to a second edge of a second movable vane, said second edge being movable through a second arc between said damper-open position and said damper-closed position;

said second sealing member having said generally rectangular cross-section when said movable vanes are in said damper-open position;

said sealing members making substantially line contact one with the other as said edges are moved toward said damper-closed position;

said side walls being maintained generally planar when said vanes are at said damper-closed position.

2. The invention set forth in claim 1 wherein said second sealing member is deformably compressed by said first sealing member when said vanes are at said damper-closed position.

3. The invention set forth in claim 2 wherein said second sealing member includes a plurality of walls defining a hollow core area.

4. A sealing apparatus for substantially preventing the flow of gaseous fluid through a damper assembly having a plurality of pivotably movable vanes and including:

an elongate, rigid, generally cylindrical first sealing member adapted to be attached to a first edge of a first movable vane, said first edge being movable from a damper-open position through a first arc to a damper-closed position;

a second, resilient sealing member adapted to be attached to a second edge of a second movable vane, said second edge being movable from a damper-open position through a second arc to a damper-closed position, said second member including a first, elongate sealing portion having a top wall, a pair of generally planar side walls and a bottom wall to define a generally rectangular cross-section, said second member further including a second support portion coupled to said first portion;

said second support portion including a foot member adapted to attach to a second edge of a second movable vane in substantially gas tight, sealing engagement therewith, said support portion further including a support rib disposed intermediate said first sealing portion and said foot member for maintaining said first sealing portion and said foot member in a spaced relationship;

said first sealing member deformably engaging said top wall of said first sealing portion for substantially preventing the flow of gaseous fluid therebetween when said damper assembly is in a closed position, said side walls being maintained substantially generally planar when said damper assembly is in said closed position.

5. The invention set forth in claim 4 wherein said second support portion is attached to said bottom wall.

* * * * *